US012233991B2

(12) United States Patent
Procter et al.

(10) Patent No.: US 12,233,991 B2
(45) Date of Patent: Feb. 25, 2025

(54) BUOY WITH BUOYANT CORE AND COLLAR HAVING MULTIPLE FLOTATION COMPONENTS

(71) Applicant: SEALITE PTY LTD, Somerville (AU)

(72) Inventors: Jeffrey Procter, Mount Eliza (AU); Graham Percy, Frankston (AU)

(73) Assignee: SEALITE PTY LTD, Somerville (AU)

( * ) Notice: Subject to any disclaimer, the term of this patent is extended or adjusted under 35 U.S.C. 154(b) by 0 days.

(21) Appl. No.: 18/187,587

(22) Filed: Mar. 21, 2023

(65) Prior Publication Data

US 2023/0219658 A1 Jul. 13, 2023

Related U.S. Application Data

(63) Continuation of application No. 16/616,779, filed as application No. PCT/AU2018/000079 on May 25, 2018, now Pat. No. 11,608,141.

(30) Foreign Application Priority Data

May 26, 2017 (AU) ..... 2017901999

(51) Int. Cl.
*B63B 22/04* (2006.01)
*B63B 5/24* (2006.01)
(Continued)

(52) U.S. Cl.
CPC ..... *B63B 22/04* (2013.01); *B63B 5/24* (2013.01); *B63B 21/20* (2013.01); *B63B 22/16* (2013.01); *B63B 2021/203* (2013.01)

(58) Field of Classification Search
CPC ..... B63B 22/04; B63B 5/24; B63B 21/20; B63B 22/16; B63B 2021/203; B63B 22/00; B63B 3/08
See application file for complete search history.

(56) References Cited

U.S. PATENT DOCUMENTS 3,315,285 A 4/1967 Walter
3,441,962 A 5/1969 Williams
(Continued)

FOREIGN PATENT DOCUMENTS

CA 2605612 A1 5/2009
CN 102358397 A 2/2012
(Continued)

OTHER PUBLICATIONS

Patent Cooperation Treaty (PCT), International Search Report and Written Opinion for Application PCT/AU2018/000079 filed May 25, 2018, mailed Aug. 22, 2018, International Searching Authority, AU.

(Continued)

*Primary Examiner* — Andrew Polay
(74) *Attorney, Agent, or Firm* — Husch Blackwell LLP

(57) ABSTRACT

The invention relates to a buoy comprising a buoyant, plastic core component, and a plurality of detachable flotation components that support and surround the core component. The buoy is preferably more than 2.5 meters diameter, but the diameter of the core component is preferably less than or equal to 2.35 meters diameter. This facilitates transport in a single shipping container. A novel tie bar assembly and novel lifting/mooring mounts are also disclosed.

14 Claims, 9 Drawing Sheets

(51) Int. Cl.
*B63B 21/20* (2006.01)
*B63B 22/16* (2006.01)

(56) References Cited

U.S. PATENT DOCUMENTS

| | | | |
|---|---|---|---|
| 5,235,337 | A | 8/1993 | Clark et al. |
| 2015/0075417 | A1 | 3/2015 | Khachaturian |
| 2016/0230746 | A1 | 8/2016 | Dagher et al. |
| 2016/0348809 | A1 | 12/2016 | Elder et al. |

FOREIGN PATENT DOCUMENTS

| | | | | | |
|---|---|---|---|---|---|
| CN | 202201138 | U | | 4/2012 | |
| EP | 0015833 | A1 | * | 3/1979 | |
| FR | 2745259 | A1 | | 8/1997 | |
| GB | 1465043 | A | * | 2/1977 | ..... B63B 22/00 |
| JP | S58211987 | A | | 12/1983 | |
| KR | 101670507 | B1 | | 10/2016 | |
| NL | 9100580 | A | | 11/1992 | |
| WO | WO-2012038763 | A1 | * | 3/2012 | ..... B63B 22/16 |
| WO | 2016200090 | A1 | | 12/2016 | |
| WO | 2018111552 | A1 | | 6/2018 | |

OTHER PUBLICATIONS

Extended European Search Report dated Feb. 9, 2021; European Patent Application No. 18806713.6.

* cited by examiner

BUOY WITH BUOYANT CORE AND COLLAR HAVING MULTIPLE FLOTATION COMPONENTS

CROSS-REFERENCE TO RELATED APPLICATION

This application claims the benefit of U.S. patent application Ser. No. 16/616,779, filed Nov. 25, 2019, which is a national stage filing of and claims the benefit of PCT/AU2018/000079, filed May 25, 2018, which claims priority to Australian patent application No. AU 2017901999, filed on May 26, 2017, the contents of which are incorporated by reference herein in their entirety.

FIELD OF THE INVENTION

The invention relates to a buoy. The present invention has particular application to marine buoys, and in particular navigational buoys.

BACKGROUND

Marine buoys are frequently used as markers in the water to serve as navigational guides. Generally, navigational buoys are secured in position by a cable or a chain which is attached to an anchor. The body of the buoy may come in different dimensions, typically ranging between 1 and 3 meters in diameter, although sizes outside this range are also possible.

Small buoys may be fully molded of plastic. For larger buoys, however, the design typically includes a steel superstructure, surrounded by large plastic flotation components to provide buoyancy. Lighting (to increase visibility and/or allow signaling), environmental monitoring sensors and other electronic equipment is often mounted on the superstructure of large buoys, meaning that the buoy can fulfill multiple functions while operational—for example, providing a visual navigational aid and monitoring sea conditions at its location.

There are numerous challenges involved in designing a navigational buoy design, and these challenges become greater as the size of the buoy increases.

At the time of manufacture, complex structures are more expensive to manufacture. Metals are stronger than plastic, but also more expensive to acquire.

Once manufactured, the buoy must be transported to its location. Transporting large buoys can also be a challenge, because the buoy diameter may be greater than the width standard shipping containers. Larger buoys can be equipped with more functional components such as a mooring post and tower, but this means that the buoy also needs a wider base to avoid tipping over in marine conditions. Furthermore, significant lifting stresses are imposed on the buoy during loading and unloading processes.

Frequently, the buoy is partly or fully assembled on land or vessel. Complex structures can be particularly difficult for workers to assemble. For some large buoys, including a large superstructure and numerous other components, it can take time to assemble the buoy in the field, which is labor-intensive and therefore costly.

During use, the buoy will then experience corrosive conditions, as well as mooring stresses which can be very significant in large swells. Therefore, on an ongoing basis, the buoy must also be regularly serviced, to ensure that it is in adequate operating condition (e.g. color is not faded or marred, electronic components are all functional, and it is sitting properly in the water). Defects must be repaired, or the buoy may need to be replaced, and ease of service is a desirable feature for maintenance workers.

The metallic components in larger buoys are also heavier (which requires additional buoyancy to support), more expensive to manufacture, and at risk of corrosion (which can pose an environmental risk and also weaken the components themselves).

The present invention aims to address, or at least ameliorate, one or more of the above disadvantages of conventional buoys, or at least to provide a commercial alternative.

SUMMARY

In an aspect of the present invention, there is provided a buoy comprising:

a buoyant core component; and two or more detachable flotation components that surround and support the core.

In an aspect of the present invention, there is provided a buoy comprising:

a buoyant core component; and three or more detachable flotation components that support the core.

The detachable flotation components can be removed for transport of the buoy. Preferably, therefore, the core is appropriately sized for ease of transport. In some embodiments, the core may be substantially circular in cross section, although other shapes (such as square or rectangular) may also be used. Preferably, the core is less than or about 2.35 meters in diameter, in order to fit within a single standard shipping container. The core may be formed of plastic.

The detachable flotation components may be collar components that form a substantially cylindrical collar around and supporting the core. In some embodiments, there may be two or three detachable flotation components. More preferably, there are four or more detachable flotation components. More preferably, there are eight detachable flotation components.

The detachable flotation components and the core component may further include engagement formations. The core component may include a downward lip projection, around a periphery of the core component, and the collar components may each include an upward lip projection. The projections of the respective lips may engage in recesses behind each lip projection, to secure the engagement between the collar and the core and to ensure that the collar provides a secure lifting force on the core component, during use of the buoy.

The buoy may further include one or more tie bars for attachment to a chain or cable, to moor the buoy to an anchor. The buoy may include a pair of tie bar assemblies, mounted within channels through the core, from a lifting point at the top of the buoy to a mooring point at the base of the buoy.

The buoy may further include a tower component additional to the core component, for attachment of functional equipment to the buoy. However, in some embodiments, functional equipment may be attached to or within the core component or the detachable flotation components.

In a further aspect of the present invention, there is provided a buoy comprising:

an upper ledge; and a lower lip formation to engage with a corresponding formation on a detachable flotation component.

The lower lip formation of the buoy may include a downward lip projection, and a recess behind the downward lip projection.

In a further aspect of the present invention, there is provided a detachable flotation component for a buoy, comprising:

an upper lip formation to engage on a ledge of a core component of the buoy; and a lower lip formation to engage with a corresponding formation on the core component.

The lower lip formation of the detachable flotation component may include an upward lip projection, and a recess behind the upward lip projection.

In an aspect of the present invention, there is provided a buoy of more than 2.6 meters diameter, comprising:

a buoyant core component; and detachable flotation components for securing to the periphery of the core component.

In an aspect of the present invention, there is provided a buoy comprising:

a plastic core component; and three or more detachable flotation components for securing to the periphery of the core component.

In an aspect of the present invention, there is provided a buoy of more than 2.6 meters diameter, comprising: comprising:

a plastic core component; and detachable flotation components for securing to periphery of the core component.

In an aspect of the present invention, there is provided a tie bar assembly for location within a component of a buoy comprising:

a rod assembly comprising one or more rods extending substantially a height of the component;

a first bracing mount fixed to a top of the rod assembly for securing to a lifting assembly, for lifting of the component during transport; and a second bracing mount fixed at a bottom of the rod assembly for securing to a mooring assembly, for mooring of the buoy during use.

In an aspect of the present invention, there is provided a bracing mount for mooring and/or lifting of a buoy comprising:

a vertical support for securing to a rod assembly; and a cross member having a cross channel therethrough, wherein the channel receives a cable or chain for mooring and/or lifting of the buoy.

Additionally, a buoy is disclosed. The buoy includes a core component, wherein the core component is a buoyant core component. The buoy further includes at least two detachable flotation components that surround and support the core component.

Furthermore, a buoy is disclosed. The buoy includes a core component, wherein the core component is a buoyant core component. The buoy further includes two or more detachable flotation components that surround and support the core component, and at least one tie bar assembly.

Moreover, a detachable floatation component for a buoy is disclosed. The component having an upper lip formation to engage a ledge of a core component of the buoy, and a lower lip formation to engage with a corresponding formation around a periphery of the core component, wherein the lower lip formation includes an upward lip projection, and a recess behind the upward lip projection.

Further aspects of the present invention will also be described in the detailed description of the invention below.

A detailed description of one or more embodiments of the invention is provided below, along with accompanying figures that illustrate by way of example the principles of the invention. While the invention is described in connection with such embodiments, it should be understood that the invention is not limited to any embodiment. On the contrary, the scope of the invention is limited only by the appended claims and the invention encompasses numerous alternatives, modifications and equivalents.

For the purpose of example, numerous specific details are set forth in the following description in order to provide a thorough understanding of the present invention. The present invention may be practiced according to the claims without some or all of these specific details. For the purposes of clarity, technical material that is known in the technical fields related to the invention has not been described in detail so that the present invention is not unnecessarily obscured.

BRIEF DESCRIPTION OF THE DRAWINGS

Preferred embodiments of the invention will now be described with reference to the accompanying drawings wherein.

DETAILED DESCRIPTION OF THE EMBODIMENTS

Figure 1:
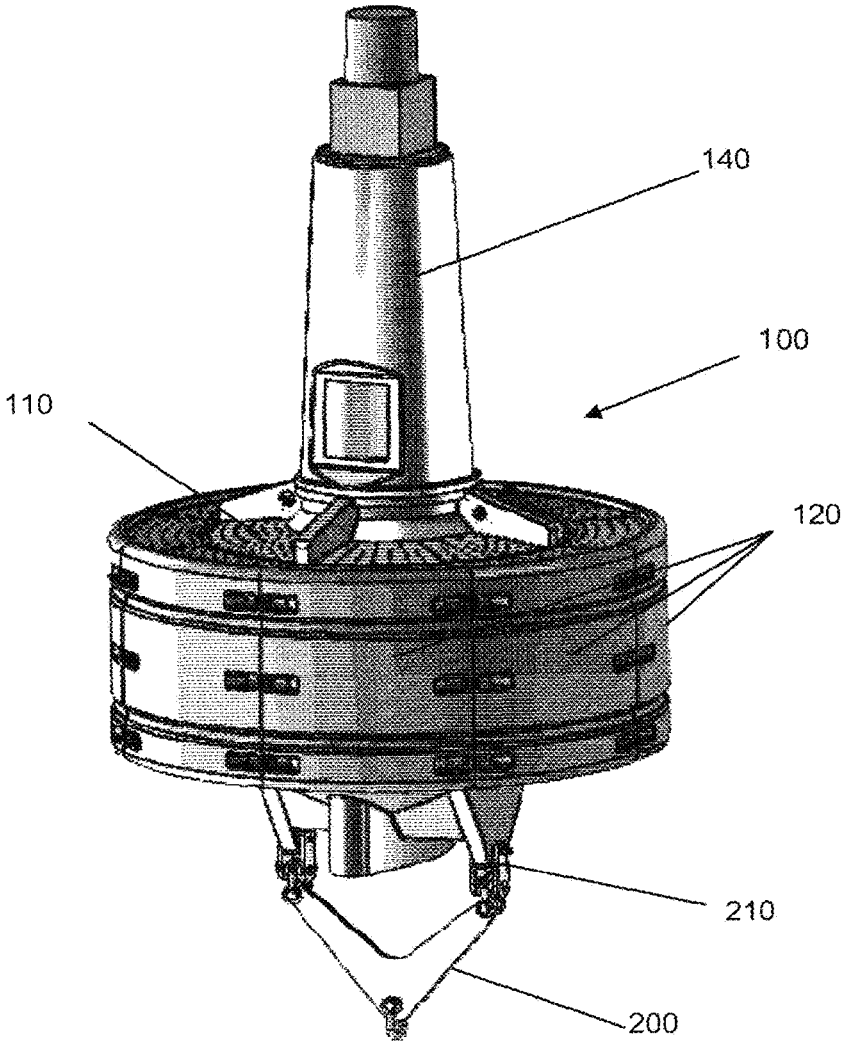
FIG. 1 is a perspective view of a buoy according to an embodiment of the invention.

FIG. 1 depicts a buoy 100 in accordance with an embodiment of the invention. In this embodiment, the buoy 100 is a buoy of 3 meters diameter, although different size buoys may be used in accordance with the invention.

The buoy 100 comprises a core 110, a collar comprised of eight collar components 120, a pair of tie bars or a tie bar assembly 130 for mooring the buoy 100 to an anchor, and a tower 140. The core 110 and collar components 120 are all molded plastic components, preferably formed of polyethylene. This means that the core 110 is buoyant. Both the plastic molded core or core 110 and collar components 120 have internal cavities, which may be filled with air, but depending on the particular application may also be filled with foam and/or a ballast material such as concrete. In this embodiment, the core 110 is more likely to be filled with ballast to suit some applications. Functional equipment can be mounted to the buoy as desired—for example, a light can be mounted at the top of the tower 140. The tower 140 in this embodiment may also be a molded plastic component, although the buoyancy of the core 110 and collar 120 means that the tower may be formed of other materials, such as steel.

Figure 2:
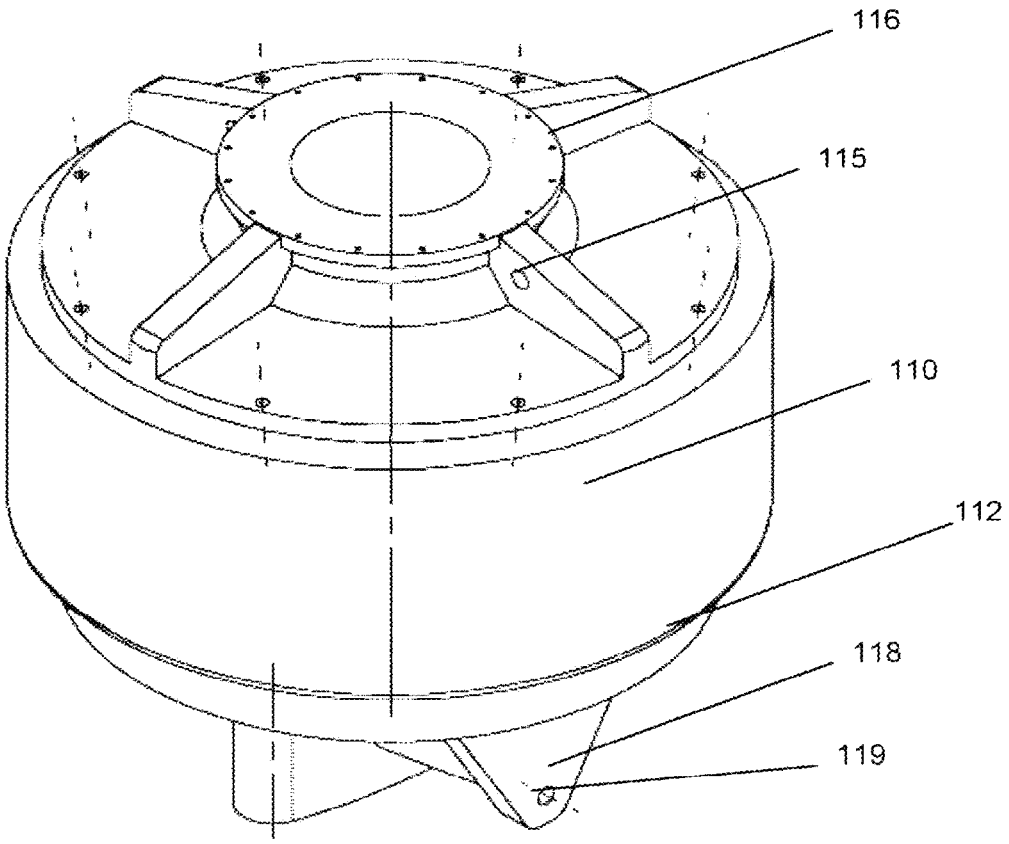
FIG. 2 is a top perspective view of a core component of the buoy of FIG. 1.
Figure 3:
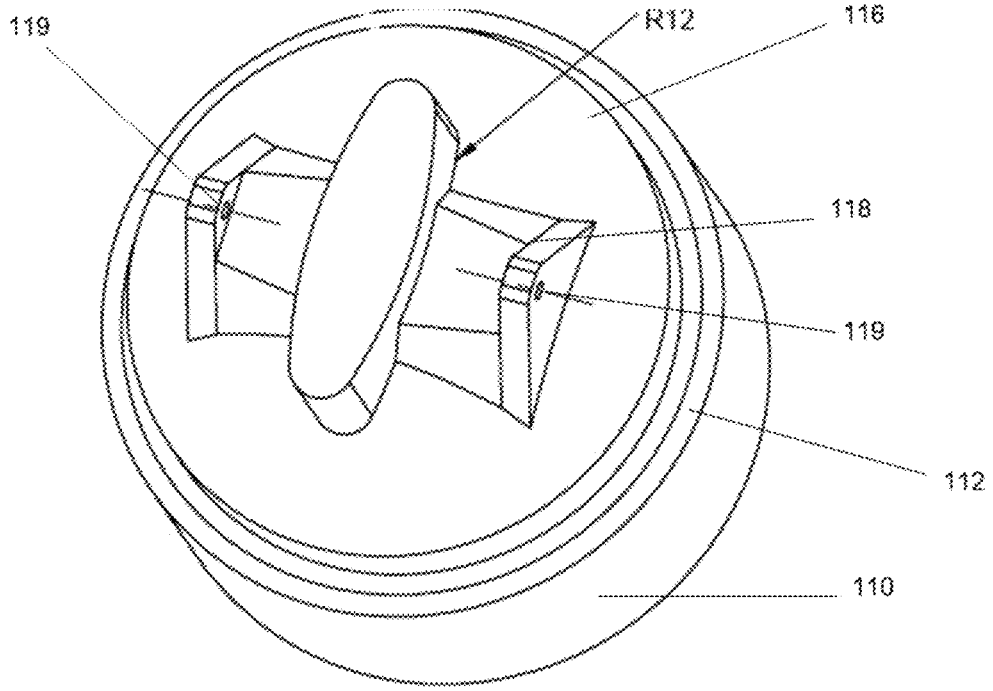
FIG. 3 is a bottom perspective view of the core component of the buoy of FIG. 1.
Figure 4:
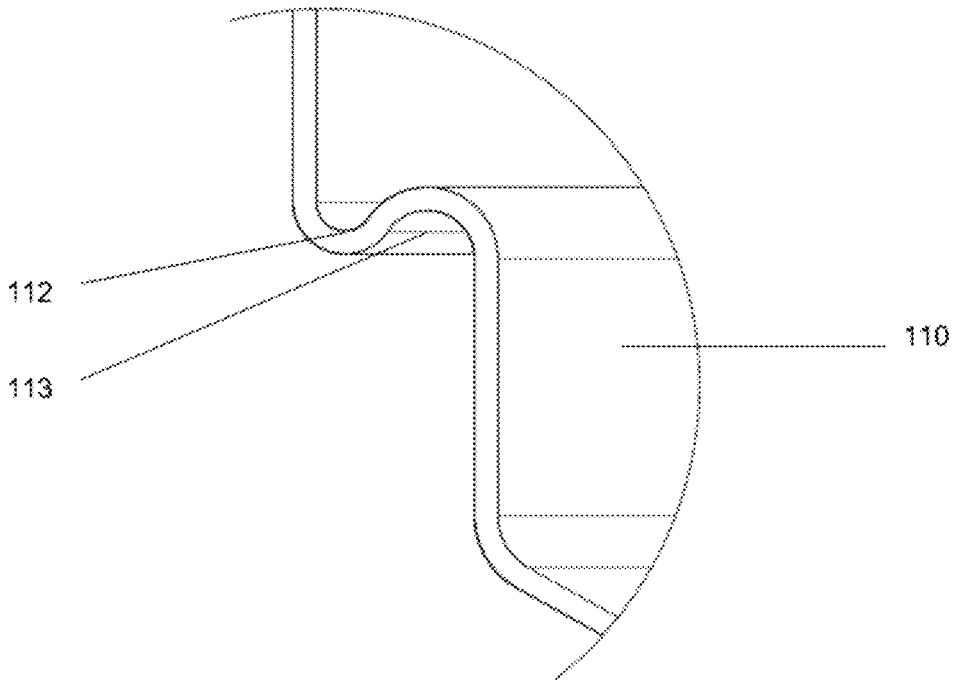
FIG. 4 is a detailed cross section of a lip towards the underside of the core component shown in FIGS. 2 and 3.

FIGS. 2 to 4 depicts the core 110 in more detail. This component is generally cylindrical with a circular cross section. In this embodiment, it has a diameter of no greater than about 2.35 meters, so that it can fit in a standard shipping container.

The core 110 may include a downward lip projection 112, around a periphery of the core component. A recess 113 is formed behind the lip projection 112. This forms a downward facing engagement portion, to engage with a mating formation on each collar component 120, which is described further below.

The core 110 further includes a tower mount 116 towards the top of the core 110, and a mooring formation 118 towards the bottom of the core 110, on the underside. Lifting holes 115 are also provided towards the top of the core 110, with mooring holes 119 provided in the mooring formation on the underside of the core 110. A cavity or channel 114 extends through the core 110, to receive a tie bar assembly 130. The tie bar assembly, described in more detail below, is formed of steel and provides strength and rigidity to allow the core 110 to withstand loads associated with lifting (e.g., during transport, retrieval and maintenance) and whilst moored (particularly in large swells).

Figure 5:
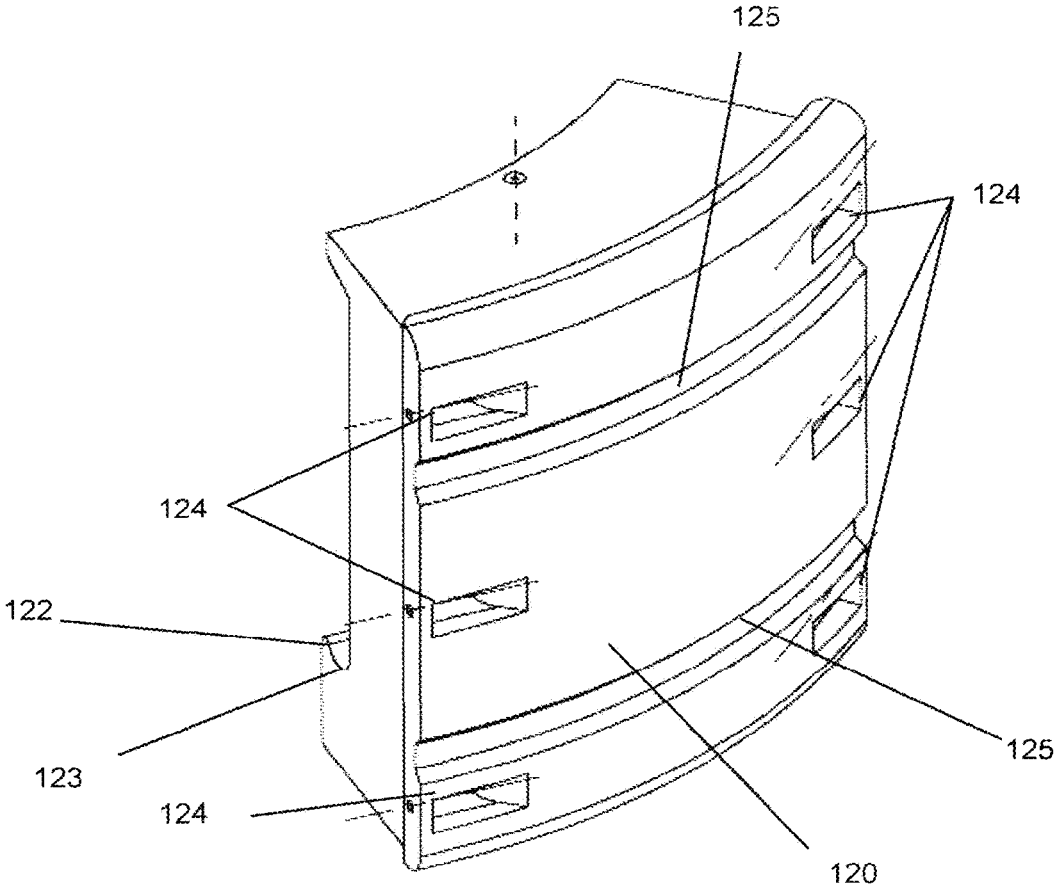
FIG. 5 is a perspective view of a collar component of the buoy of FIG. 1.
Figure 6:
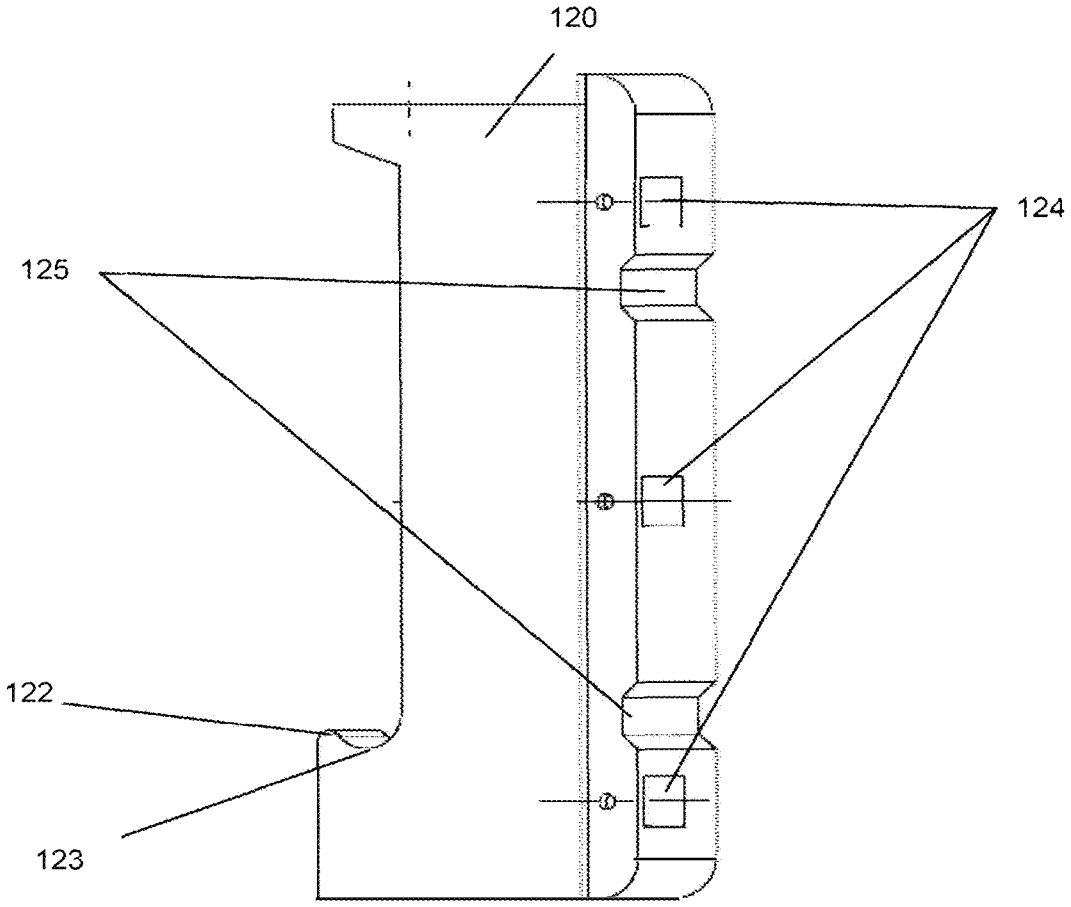
FIG. 6 is a vertical cross section of the collar component of FIG. 5.

FIGS. 5 and 6 depict a collar component 120 in more detail. Collectively, eight of these collar components 120 create a collar around the periphery of the core 110, as shown in FIG. 1. The eight collar components surround the core, and form a cylinder or 'donut' to support the core and provide additional stability and buoyancy. Of course, different shapes and configurations of collar components 120 may be used in different embodiments of the invention.

Each collar component 120 is detachable from the core 110 (particularly for transport), and formed of plastic. The collar components 120 provide additional buoyancy to the buoy 100, and also ensure that the buoy 100 has a wide base to improve stability in large swells. The resulting wide base helps the buoy 100 support a tower and/or have more functional equipment (such as sensors or lights) mounted to it. However, because the collar components are detachable, this means the buoy can be transported in a disassembled state, significantly reducing transport costs—in this embodiment, the assembled buoy (3 meters in diameter) would not fit within a standard shipping container of 2.35 meters width.

Towards the top of each collar component, an upper lip 128 is provided, projecting inwards. In use, this lip will locate over a corresponding ledge of the core 110, where it will help maintain the collar component 120 on the core 110 (primarily when out of the water, and the components are not buoyed upward).

Towards the bottom or each collar component 120, there is also an upward lip projection 122, along an inner edge of the collar component 120. A recess 123 is formed behind the lip projection 122. Together, these provide an upward facing engagement formation to engage with the corresponding formation (or projection 112 and/or recess 113) of the core 110.

Figure 7:
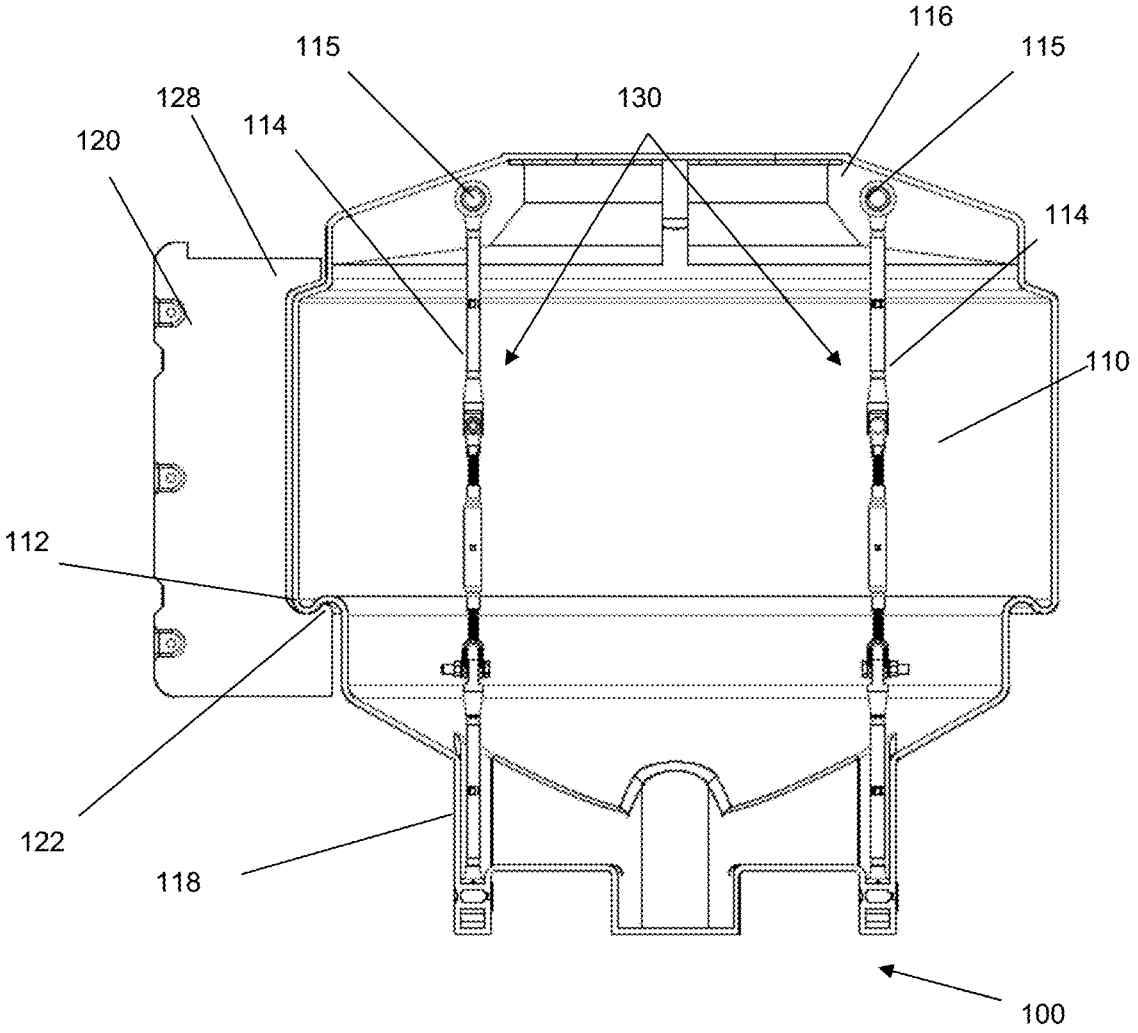
FIG. 7 is a vertical cross section of the assembled buoy of FIG. 1.
Figure 8:
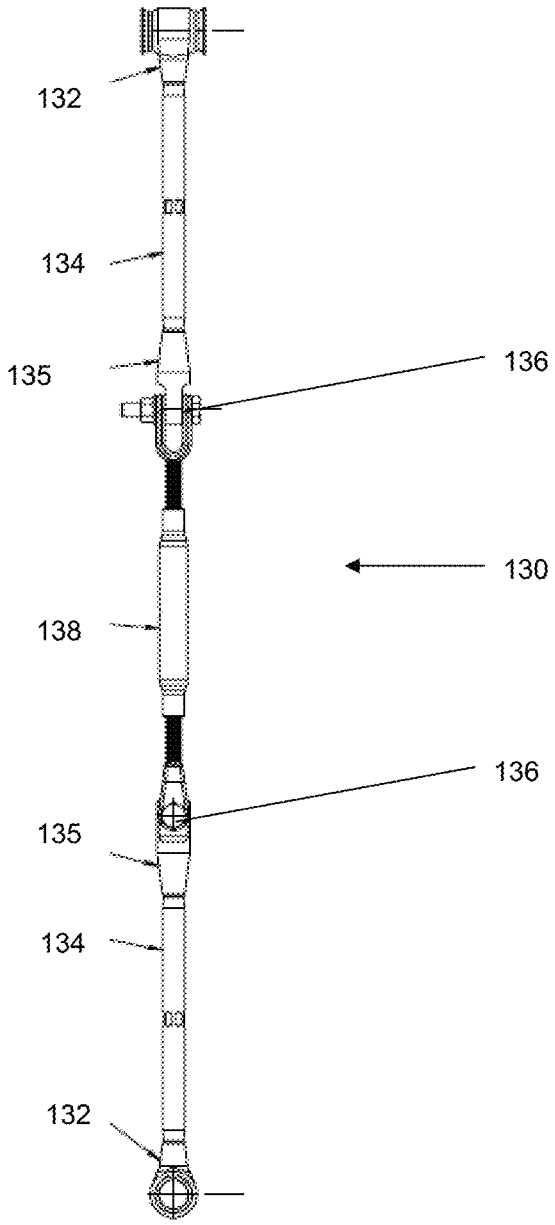
FIG. 8 is a front view of a tie bar assembly for the buoy of FIG. 1.
Figure 9:
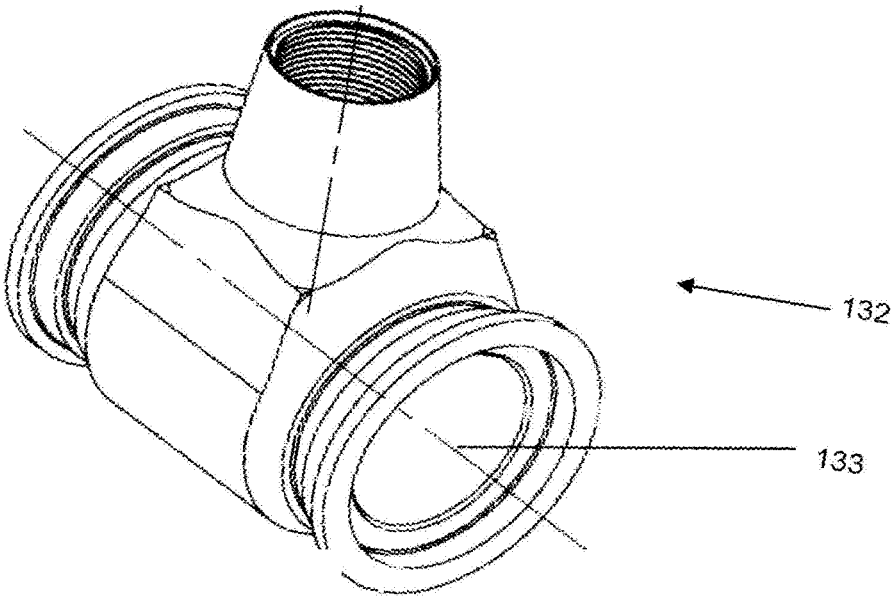
FIG. 9 is a perspective view of a mounting component of the tie bar assembly of FIG. 8.

FIG. 7 depicts the core 110 and collar component 120 as assembled, in cross section. This engagement resists outward motion of the collar components 120 relative to the core 110, and also resists downward motion of the core relative to the collar components 120, meaning that the buoyancy of the collar components 120 directly supports the core 110.

To secure the collar in place, the collar components 120 are fixed together using a nut and bolt arrangement, through bolt apertures 124, around the circumference of the collar. Optionally, tie straps may be provided around the outside of the collar, and located in external channels 125 on the collar components 120, although tie straps will often be unnecessary in many embodiments.

Assembly of the buoy 100 of the present invention is therefore much simpler and faster than the assembly process for conventional large marine buoys. Typically, such buoys have a heavy steel superstructure, and may have complicated fixing means to secure flotation components to the superstructure. This makes them very difficult to assemble in the field.

In addition, the components of the buoy 100 described above are formed of plastic, without the requirement for a steel superstructure. This significantly reduces the manufacturing cost of the buoy 100.

Furthermore, the buoy 100 of the present invention is likely to be more reliable and more easily serviced than conventional large marine buoys. The use of multiple (preferably three or more) detachable flotation components or collar components 120 means that there is more redundancy in the buoy itself. If one collar component 120 is damaged, this does not greatly affect the buoyancy of the buoy 100 itself. The buoy 100 will also be less expensive to repair in such circumstances, as only the damaged collar component 120 need be replaced. The ease of replacement is also likely to address occupation health and safety concerns.

Furthermore, in some cases, the use of multiple collar components 120 may allow a buoy 100 to be more easily reconfigured with additional functional equipment. Functional equipment can be installed in a specific collar component 120, which can then be secured to the buoy—either at the time of assembly for a particular function, or to add functionality or reconfigure a buoy already in use. In a most basic configuration, the core 110 could be used as a buoy in its own right, without any additional collar components 120. In other embodiments, functionality (as well as additional width and buoyancy) could be provided by customized/specific collar components.

Figure 10:
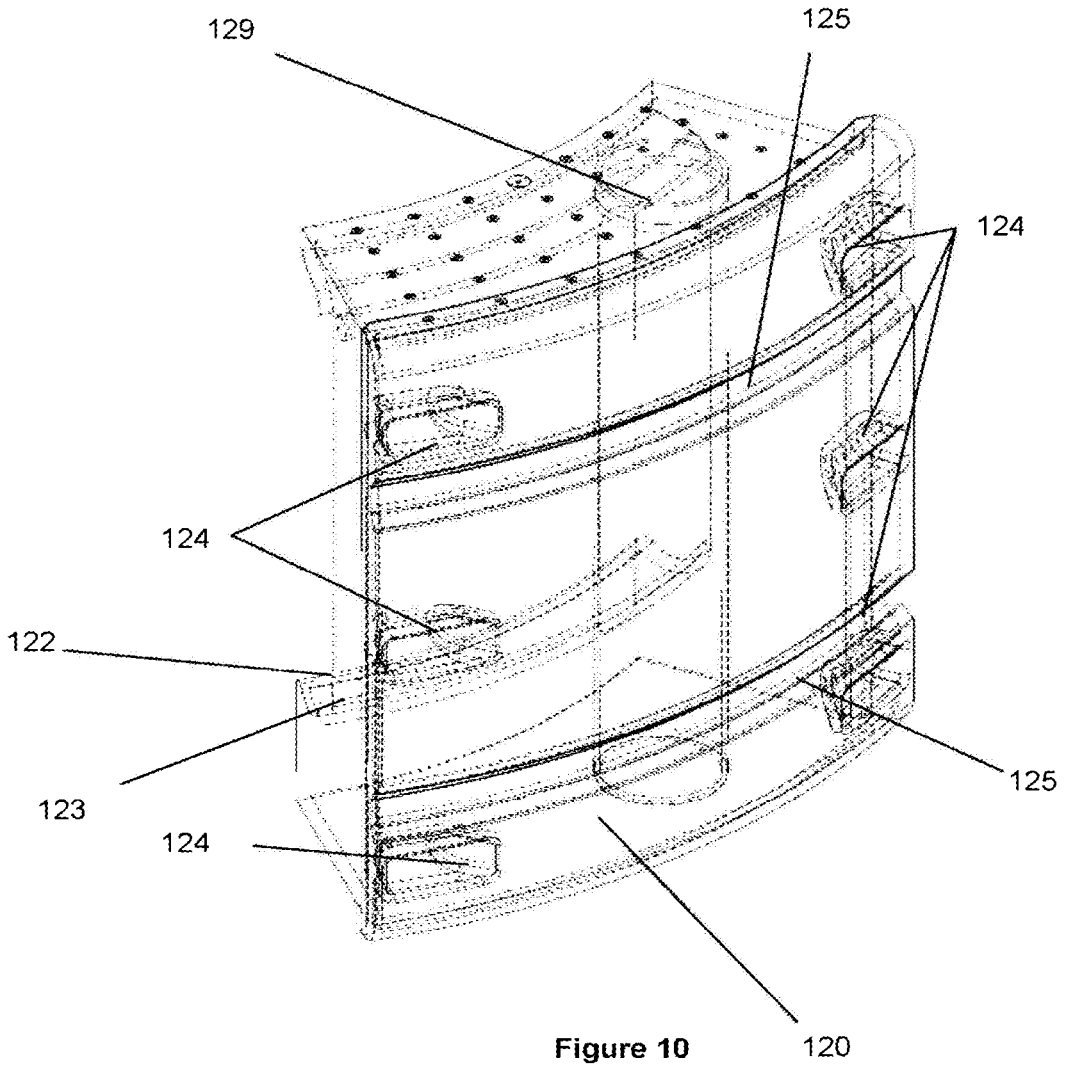
FIG. 10 is a transparent perspective view of a collar component modified for particular environmental applications.

For example, FIG. 10 shows a customized collar component 120 having an additional through-hole 129, which can be used to receive environmental monitoring equipment, for example to measure salinity or heavy metal in the water below the buoy. In conventional buoys, environmental monitoring probes must either be located around the outside of the buoy (highly undesirable, as it makes them more susceptible to damage) or an entire buoy must be customized to include a cavity to receive the probe within it. This typical modification means that significant additional costs are incurred to customize a large buoy for an environmental monitoring application—and results in additional transport costs, because the entire buoy is first transported to a location for the environmental probes to be installed, and then to the port for deployment. Utilizing the present invention, however, transport and customization costs are reduced because only a collar component 120 (not the entire buoy 100) needs to be customized and transported.

The figures depict a tie bar assembly 130 according to an embodiment of the invention. The tie bar assembly includes a pair of outer bracing rods 134, with a middle bracing rod 135 also provided. Bolts 136 are passed through forks at the end of rod 138, and connector pieces on the end of rods 134 are used to connect the rods together. All of the components of tie bar assembly 130 are formed of strengthened steel. In other embodiments, different materials and/or different connection means may be used.

Importantly, bracing mounts 132 are provided at the top and bottom of the tie bar assemblies 130. Each bracing mount 132 is generally T-shaped, and includes a vertical support for securing to the rest of the tie bar assembly 130, and a cross member having a cross channel 133 therethrough.

In use, a pair of tie bar assemblies 130 are mounted within channels or cavities of the core 110. At the top of the tie bar assembly 130, the upper bracing mount 132 is located in lifting holes 115 of the core component or core 110. At the bottom of the tie bar assembly 130, the lower bracing mount is secured by a pin through the mooring holes 119, as shown in FIG. 1.

The upper bracing mount 132 will provide a lifting point for lifting the core 110 during transport, deployment and retrieval, with a cable or chain received in the channel 133 of the upper bracing mount 132. The channel of 133 of lower bracing mount 132 can likewise receive a cable or chain for mooring purposes, or a pin to secure a bridle plate 200 using an additional shackle 210 as shown in FIG. 1. The tie bar assembly 130 provides sufficient strength to withstand the significant loads and stresses experienced by the buoy during handling and when moored. By providing a pair of tie bar assemblies, this means that the mooring and lifting loads can be spread evenly.

Throughout this specification and the claims which follow, unless the context requires otherwise, the word "comprise", and variations such as "comprises" and "comprising", will be understood to imply the inclusion of a stated integer or step or group of integers or steps, but not the exclusion of any other integer or step or group of integers or steps.

The reference in this specification to any prior publication (or information derived from it), or to any matter which is known is not, and should not be taken as an acknowledgment or admission or any form of suggestion that that prior publication (or information derived from it) or known matter forms part of the common general knowledge in the field of endeavor to which this specification relates.

What is claimed is:

1. A buoy comprising:

a core component, wherein the core component is a buoyant core component; and at least two detachable flotation components surround and support the core component, wherein each detachable flotation component and the core component include respective engagement formations to engage with each other, and wherein at least one engagement formation on the core component includes a downward lip projection, around a periphery of the core component, and each detachable flotation component includes an upward lip projection, whereby the respective lip projections may engage in recesses behind another lip projection.

2. The buoy according to claim 1, wherein the buoy is more than 2.6 meters diameter.

3. The buoy according to claim 1, wherein the core component is a plastic core component.

4. The buoy according to claim 1, wherein the core component is substantially circular in cross section, and each detachable floatation component forms a substantially cylindrical collar around the core component.

5. The buoy according to claim 1, further comprising at least three detachable floatation components.

6. The buoy according to claim 1, wherein each detachable floatation component comprises an upper lip to engage on a ledge of the core component.

7. A buoy comprising:

a core component, wherein the core component is a buoyant core component, two or more detachable flotation components that surround and support the core component, wherein each detachable flotation component and the core component include respective engagement formations to engage with each other, and wherein at least one engagement formation on the core component includes a downward lip projection, around a periphery of the core component, and each detachable flotation component includes an upward lip projection, whereby the respective lip projections may engage in recesses behind another lip projection, and a pair of tie bar assemblies, the pair of tie bar assemblies being mounted within the core component and providing a lifting point towards the top of the buoy and a mooring point towards the bottom of the buoy.

8. The buoy according to claim 7, wherein each tie bar assembly comprises:

a rod assembly comprising one or more rods extending substantially a height of the core component;

a first bracing mount fixed to a top of the rod assembly for securing to a lifting assembly, for lifting of the core component; and a second bracing mount fixed at a bottom of the rod assembly for securing to a mooring assembly, for mooring of the buoy during use.

9. The buoy according to claim 8, wherein the first and second bracing mounts each comprise:

a vertical support for securing to the rod assembly; and a cross-member having a cross channel therethrough, wherein a channel receives a cable, chain or pin for at least one of mooring and lifting of the buoy.

10. A detachable floatation component for a buoy comprising:

an upper lip formation to engage a ledge of a core component of the buoy, wherein the upper lip formation faces toward a vertical center of the core component; and a lower lip formation to engage with a corresponding formation around a periphery of the core component, wherein the lower lip formation includes an upward lip projection, and a recess behind the upward lip projection.

11. A detachable floatation component according to claim 10, wherein the recess is a downward recess that is behind the upward lip projection away from a center of the core component.

12. A detachable floatation component according to claim 10, wherein the lower lip formation is adapted to engage a downward lip projection and an upward recess of a corresponding lip formation of the core component of the buoy.

13. The buoy according to claim 1, wherein a diameter of the core component is less than 2.35 meters.

14. The buoy according to claim 1, further comprising at least eight detachable flotation components.

* * * * *